US006129470A

United States Patent [19]

Fang

[11] Patent Number: 6,129,470

[45] Date of Patent: Oct. 10, 2000

[54] CAP ON A PEN

[76] Inventor: Te-Hsiang Fang, No. 130, Lane Ping Road, San Chung, Taipei Hsien, Taiwan

[21] Appl. No.: 09/449,858

[22] Filed: Nov. 29, 1999

[51] Int. Cl.[7] ..... B43K 25/00

[52] U.S. Cl. ..... 401/52; 401/195

[58] Field of Search ..... 401/52, 195, 213, 401/243, 246

[56] References Cited

U.S. PATENT DOCUMENTS 2,529,764 11/1950 Dufulho ..... 401/52

3,639,069 2/1972 Gordon ..... 401/52

5,544,437 8/1996 Lanoie ..... 401/52

*Primary Examiner*—David J. Walczak

*Attorney, Agent, or Firm*—Dougherty & Troxell

[57] ABSTRACT

A cap on a pen comprises a cap body, a decoration head, and decoration flaps. The cap body is cylindrical and has an internal space therein for receiving a penholder. The decoration head is made of transparent material, which has a curved outer end, and a recess seat. Each of the decoration flaps is adhered by a mark. The mark is magnified by means of a curved outer end on the decoration head.

4 Claims, 2 Drawing Sheets

CAP ON A PEN

BACKGROUND OF THE INVENTION

1. Field of the Invention

The present invention relates to a cap on a pen, and particularly to a cap, which fits with a penholder and enhances the durability and the visual desirability of marks thereon.

2. Description of Related Art

Normally, a pen comprises a penholder and a cap fitting with the penholder. The cap is provided with a clip such that the pen is able to attach to a pocket on clothes. A way for the cap engaging with the penholder is that the cap has to separate from the penholder while using the pen. Another way for the cap engaging with the penholder is that the cap is kept in touch with the penholder, and the pen is pushed to expose a jotter while using it. Pens can have added marks such as characters or symbols thereon for advertisement or specific purpose and can be utilized for giving others as gifts.

Conventionally, marks such as characters, and symbols on a pen can be printed on the penholder, on the cap or on the clip. As for a pen of high class, the marking symbols such as trademark, figures are usually arranged at a top end of the cap. But, the marks on the pen are easy to become decayed after using a period of time. Furthermore, the size of a penholder is not possible to be made larger due to the requirement of human engineering such that the marks have to be restricted in a small area and it results in an undesirable appearance.

SUMMARY OF THE INVENTION

An object of the present invention is to provide a cap on a pen, in which the cap is designed to keep marks on the pen in good condition all the time.

Another object of the present invention is to provide a cap on a pen in which the cap furnishes desirable visual enhancement.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
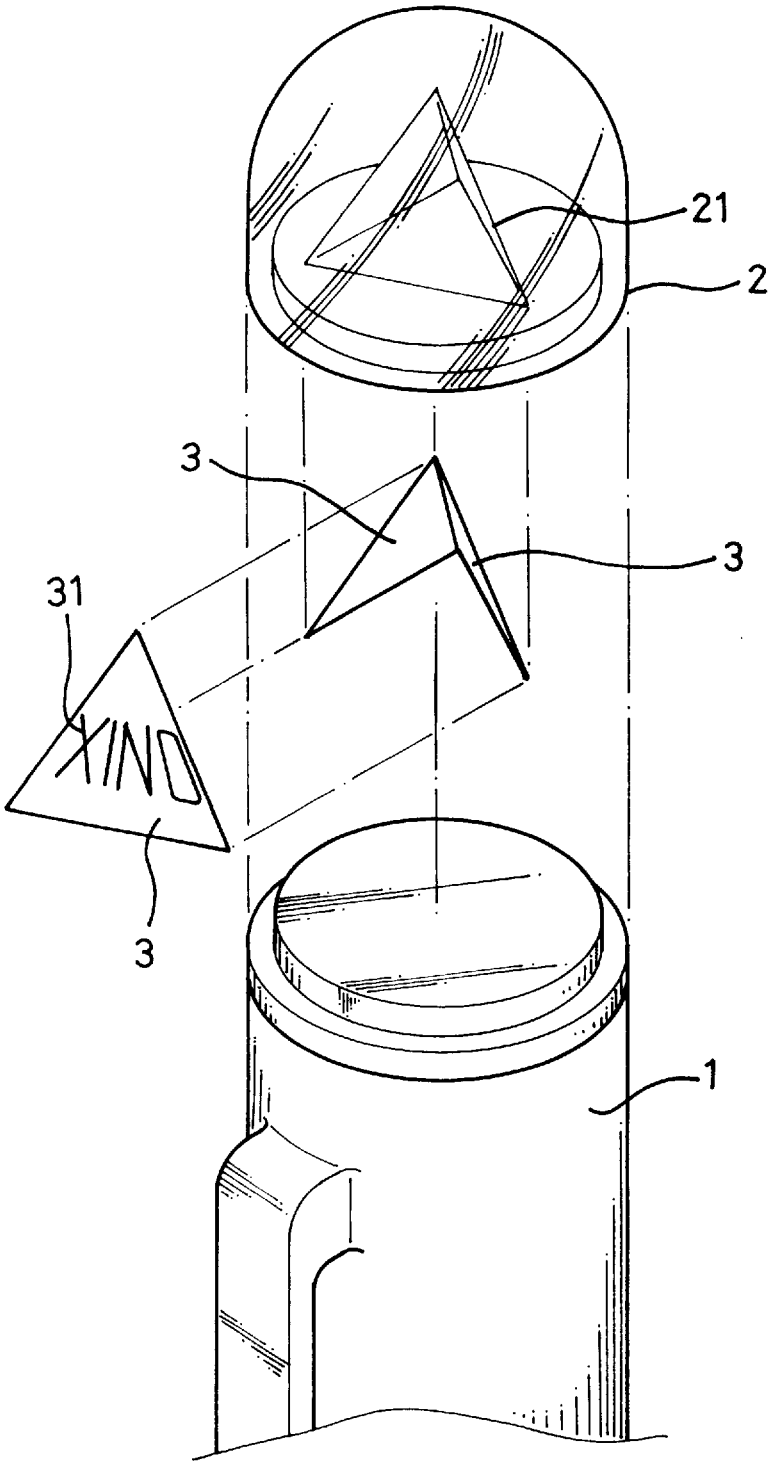
FIG. 1 is an exploded perspective view of a cap on a pen in a preferred embodiment according to the present invention.
Figure 2:
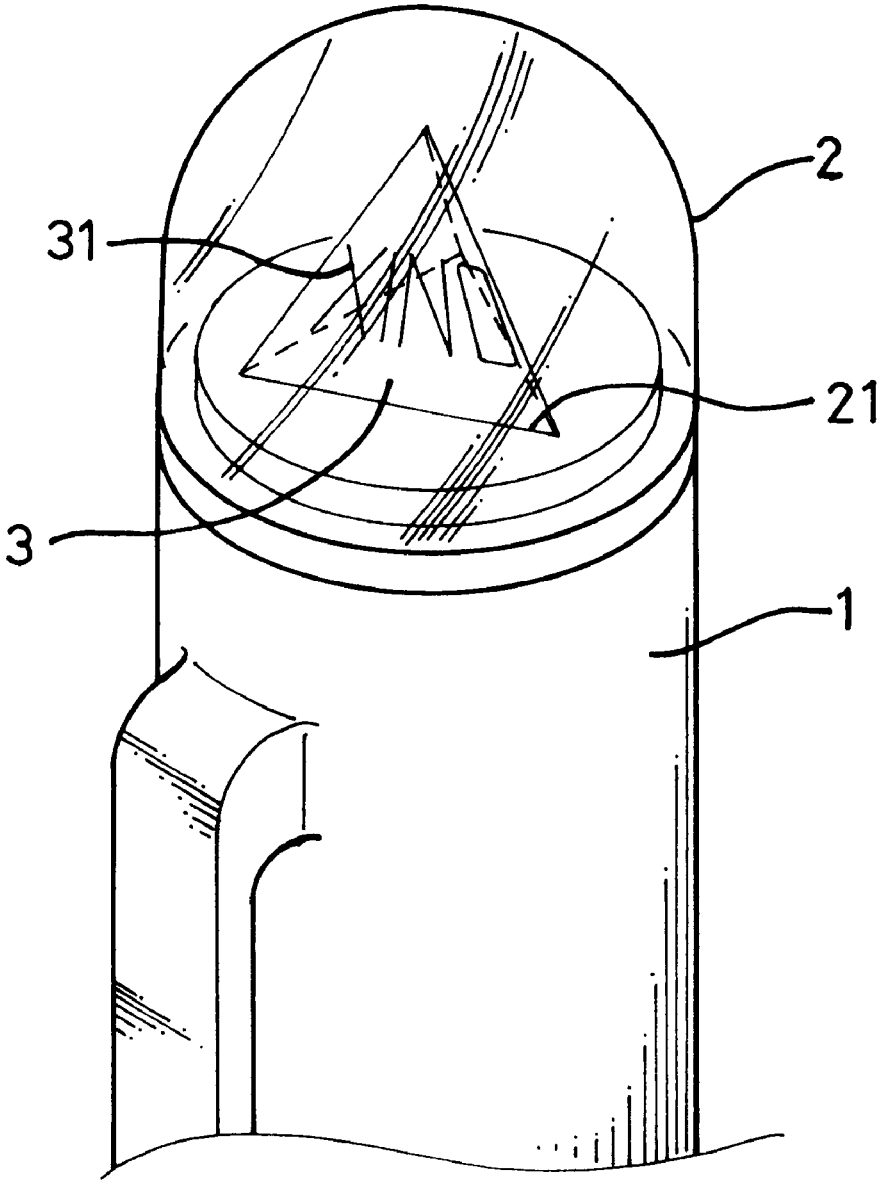
FIG. 2 is an assembled perspective view of FIG. 1.

Referring to FIG. 1 and 2, a cap on a pen in a preferred embodiment according to the present invention is sleeved to a pen or is turned to engage with the pen. The cap basically comprises a cap body 1, a decoration head 2, and decoration flaps 3. The cap body 1 is cylindrical, and provides a hollow space to receive part of the pen. An upper end of the cap body 1 is an opening end or a closed end for connecting with the decoration head 2. A clip may be or may be not located at the cap body 1.

The decoration head 2 has a curved end of hemispherical shape in the preferred embodiment shown in FIGS. 1 and 2. The head 2 is made of transparent material such as crystal, acrylic, or glass, and the head 2 is provided with a function of a magnifier lens. A recess seat 21 is arranged in the head 2, and the recess seat 21 can be made as a specific shape such as semi-sphere, cube, or pyramid. As shown in FIGS. 1 and 2, the recess seat 21 is a shape of pyramid for locating the decoration flaps 3.

The decoration flaps 3 bear marks thereon and are adhered to the entire surface of the recess seat 21. For instance, a recess seat 21 of a cubic shape has a surface composed of four lateral sides and an upper side. Each side of the surface corresponds to a decoration flap 3 respectively and the decoration flap 3 is adhered to the recess seat 21 accordingly. As shown in the preferred embodiment, the recess seat 21 of the pyramid is composed of three triangular sides and each side is adhered by a triangular decoration flap 3 respectively.

Referring to FIG. 2 again, while the decoration flaps 3 are adhered to the surface of the recess seat 21, the decoration mark 31 on each decoration flap 3 faces one of sides on the surface of the decoration head 2. The adhesion associated with recess seat 21 and the decoration flaps 3 can be carried out by a conventional way such as glue, screw fasteners, or press fit. Finally, the decoration head 2 is attached to a flat end of the cap body 1.

After the cap is completely assembled, the curved end of the cap body 1 makes the decoration flaps 3 magnified appropriately while it is viewed from outsides. Therefore, it can be understood that a visual desirability of the decoration flaps 3 can be greatly enhanced. In addition, the head 2 is durable such that the decoration flaps 3 won't decay after a period of time.

While the invention has been described with reference to preferred embodiment thereof, it is to be understood that modifications or variations may be easily made without departing from the spirit of this invention, which is defined by the appended claims.

What is claimed is:

1. A cap for a pen, comprising a cap body, being cylindrical and having an internal space therein for receiving a pen;

a decoration head, being made of transparent material, having a curved outer end, having a recess seat with an internal surface therein, and fitting with said cap body; and a plurality of decoration flaps, each of said decoration flaps having a mark thereon, and adhering to said internal surface of said recess seat;

whereby, said mark is magnified by means of said curved outer end on said decoration head.

2. A cap on a pen according to claim 1, wherein said recess seat in said decoration head has a pyramid shape.

3. A cap on a pen according to claim 1, wherein said flaps are glued to said recess seat.

4. A cap on a pen according to claim 1, wherein said decoration head is hemispherical in shape and is made of acrylic.

* * * * *